US005927707A

United States Patent [19]

Miura

[11] Patent Number: 5,927,707

[45] Date of Patent: Jul. 27, 1999

[54] IMAGE FORMING APPARATUS HAVING A UNIVERSAL CASSETTE

[75] Inventor: Kazunobu Miura, Hachioji, Japan

[73] Assignee: Konica Corporation, Tokyo, Japan

[21] Appl. No.: 08/976,876

[22] Filed: Nov. 24, 1997

[30] Foreign Application Priority Data

Nov. 27, 1996 [JP] Japan ..... 8-316188

[51] Int. Cl.[6] ..... B65H 1/00

[52] U.S. Cl. ..... 271/171

[58] Field of Search ..... 271/171, 162

[56] References Cited

U.S. PATENT DOCUMENTS 5,537,195 7/1996 Sagara et al. ..... 271/171 X

FOREIGN PATENT DOCUMENTS 5286577 11/1993 Japan ..... 271/171

*Primary Examiner*—David H. Bollinger

*Attorney, Agent, or Firm*—Frishauf, Holtz, Goodman, Langer & Chick, P.C.

[57] ABSTRACT

A universal sheet cassette includes a sheet stacking body, plural stopping sections predetermined at different positions in the sheet stacking body in accordance with plural different sheet sizes, a trailing end stopper adapted to be detachably attached to one of the plural stopping sections in accordance with the sheet size to be accommodated, and a sheet size detecting member having a projecting section. When the universal cassette is dismounted from a predetermined position of an apparatus body, the projecting section is spaced far from the trailing end stopper, and when the universal cassette is mounted at the predetermined position of the apparatus body, the projecting section is adapted to come in contact with or in non-contact with the trailing end stopper in accordance with the attached position of the trailing end stopper. A controller determines the sheet size based on the contact or the non-contact between the projecting section and the trailing end stopper when the universal cassette is mounted in an apparatus body and indicates the determined sheet size.

8 Claims, 5 Drawing Sheets

IMAGE FORMING APPARATUS HAVING A UNIVERSAL CASSETTE

BACKGROUND OF THE INVENTION

The present invention relates to a universal cassette capable of housing plural recording papers having different sizes and a device to display the size of the recording papers housed in aforesaid universal cassette integral in an image forming apparatus.

As a means for feeding a recording paper into an image forming section inside an image forming apparatus, various paper feeding cassettes capable of feeding papers stably are frequently used. However, in order to attain a simpler structure and lower price, there are several paper feeding cassettes which can only house limited kinds of sizes. Namely, both sides guide members which maintain recording papers at a prescribed position in a paper feeding cassette and a trailing end stopping member which stops trailing end of recording papers to the paper feeding direction are fixed in a paper feeding cassette. Therefore, recording papers having several prescribed sizes can be housed. If the above-mentioned type paper feeding cassettes are used, in order to use recording papers having several other kinds of sizes, it is necessary to house many kinds of paper feeding cassettes which are used exclusively for a respective recording paper size in an image forming apparatus, causing the entire apparatus to become rather large.

Accordingly, a universal cassette capable of housing plural sizes of recording papers has come to be used. With regard to the structure of aforesaid universal cassette, guide members at the both sides of the recording papers and at the trailing end stopping member which stops trailing end are provided slidably for various sizes of recording papers. After aforesaid members are slid to the prescribed positions corresponding to each size, they are fixed for maintaining recording papers. In this situation, due to synchronous movement of the above-mentioned cam member and the sliding movement of the trailing end stopping member which touches a cam member formed on recording papers size detection member, plural units of the above-mentioned recording papers size detection members operate.

In a universal cassette constituted as above, when replacing recording papers having different sizes each other, the trailing end stopping member which stops trailing end of recording papers is slid in accordance with the size of recording papers. When the size of the recording paper is changed from a smaller to larger, or when the position of the paper is changed from a horizontal one to a vertical one, the length of sliding of the above-mentioned trailing end stopping member becomes longer. When conducting aforesaid sliding operation, the above-mentioned trailing end stopping member touches plural cam members. Accordingly, movement operation of the above-mentioned trailing end stopping member cannot be conducted smoothly. In addition, more or less skill was necessary for stopping the above-mentioned trailing end stopping member at the correct position while it touches cam members. Therefore, there were cases in which recording papers was housed in the universal cassette without stopping the above-mentioned trailing end stopping member at a precise position. In such occasions, recording papers could not be fed stably, causing jamming.

Further, in order to slide the trailing end stopping member, parts such as rails, guides, stoppers, sliding members and handles are necessary. Therefore, structure of the apparatus becomes complicated. Similarly, the structure of the recording paper size detection member becomes complicated.

SUMMARY OF THE INVENTION

The present invention was contrived for overcoming the above-mentioned problems. Namely, an object thereof is to move the above-mentioned trailing end stopping member simply and surely without contacting the above-mentioned cam member.

The above-mentioned object of the present invention can be attained by the following constituent.

In an image forming apparatus having a universal cassette composed of a recording papers housing section capable of housing recording papers having plural kinds of paper sizes and a display section which displays the size of the recording papers housed in aforesaid recording papers housing section, by housing aforesaid universal cassette composed of a both sides recording papers guide members which move in accordance with the size of recording papers which is housed in the above-mentioned recording papers housing section, a trailing end stopping member provided detachably inside the above-mentioned recording papers housing section for stopping the trailing end of recording papers housed in the above-mentioned recording papers housing section in paper feeding direction and a recording papers size detection member provided for detecting the size of recording papers which contact with the above-mentioned trailing end stopping member at the time of completing of loading aforesaid universal cassette into an image forming apparatus in aforesaid image forming apparatus, the above-mentioned recording papers size detection member is brought into contact with the above-mentioned trailing end stopping member for detecting the size of recording papers and the size of aforesaid recording papers is displayed on a part of aforesaid image forming apparatus.

When the above-mentioned universal cassette is pulled out of the above-mentioned image forming apparatus, the above-mentioned trailing end stopping member is separated from the above-mentioned recording papers size detection member so that aforesaid trailing end stopping member is detachable from the recording papers housing section.

The above-mentioned recording paper size detection member is constituted of plural movable detection members. At the mounted position of the above-mentioned trailing end stopping member, plural of the above-mentioned movable detection members are brought into contact with the above-mentioned the trailing end stopping member so that operation distance of plural movable detection member is changed. As a result, the size of recording papers is detected.

A universal cassette loaded in a prescribed position in an image forming apparatus and capable of housing recording papers having an optional size among plural of different size of recording papers has the following constitution, namely:

- a box-shaped housing section which houses recording papers (which is conveyed to a prescribed paper feeding direction from aforesaid housing section;
- a trailing end stopping member which stops the trailing end in the papers conveyance direction;
- plural trailing end stopping member mounting section provided at different positions in aforesaid housing section in accordance with the position of the trailing section of the recording paper having different kind of sizes in the paper feeding direction, wherein the above-mentioned trailing end stopping member is mounted detachably on aforesaid trailing end stopping member mounting section; and
- when a recording paper size detection member having a cam surface on which a protrusion section is provided and a universal cassette is removed from an image forming apparatus, aforesaid recording paper size detection member is separated from the trailing end stopping member, enabling that detachment of the above-mentioned trailing end stopping member from/onto the above-mentioned trailing end stopping member mounting section. When a universal cassette is loaded on an image forming apparatus, the protrusion section on the cam surface is or not is brought into contact with the trailing end stopping member in accordance with the mounting position of the trailing end stopping member. Due to aforesaid contact or non-contact, the size of the recording paper is detected.

BRIEF DESCRIPTION OF THE INVENTION

DETAILED DESCRIPTION OF THE INVENTION

Figure 1:
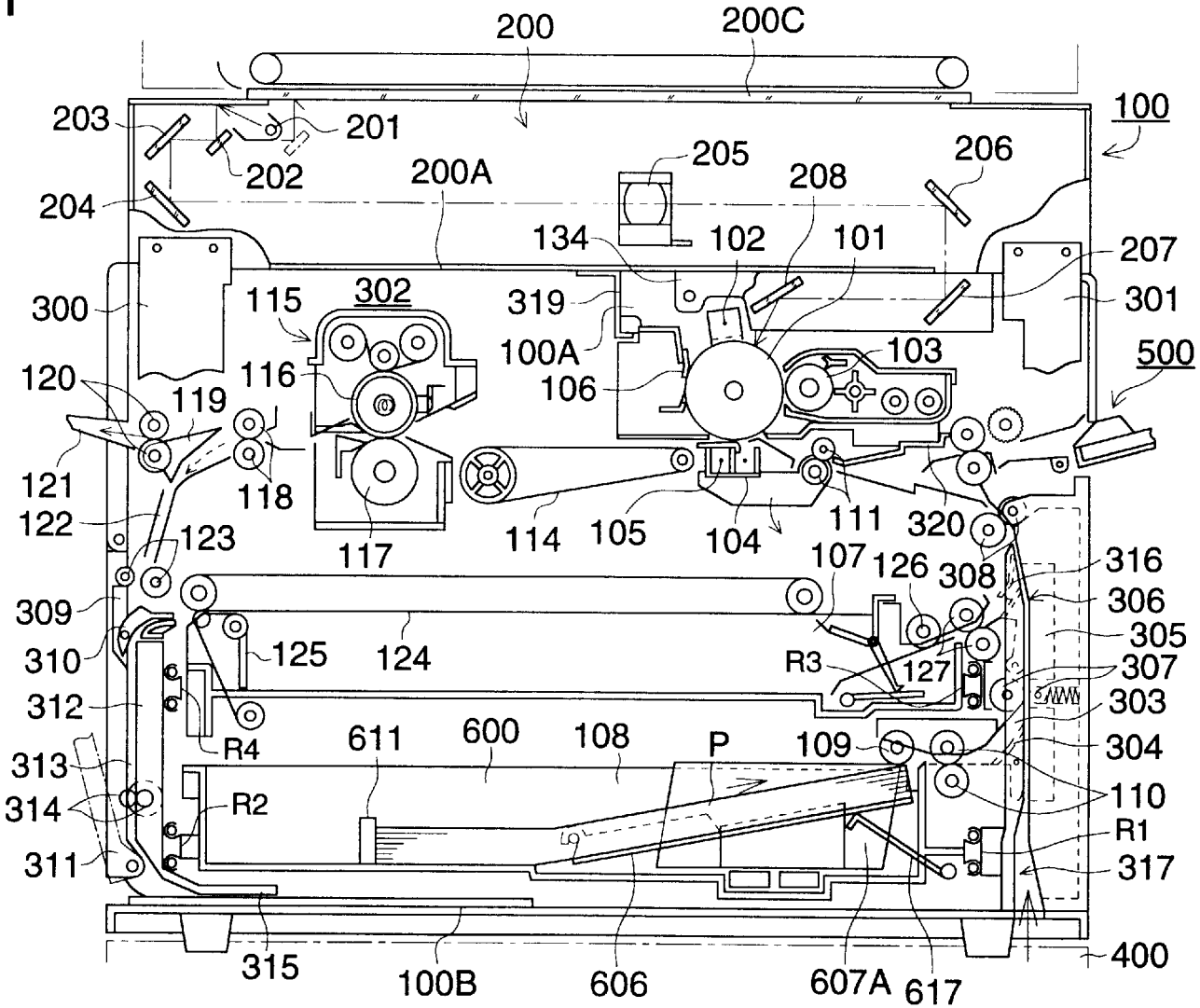
FIG. 1 is a front view showing an overall structure of the image forming apparatus of the present invention.

FIG. 1 is a front view showing the general structure of image forming apparatus 100 of the present invention.

The constitution of the above-mentioned image forming apparatus 100 is as follows. At the periphery of photoreceptor 101 provided inside aforesaid image forming apparatus 100, charger 102, developing device 103, image-transfer device 104, separation device 105 and cleaning device 106 are located in the order of operation. As image forming unit 10A, photoreceptor 101, charger 102, developing device 103 and cleaning device 106 are integral. After charge is provided on the surface of the above-mentioned photoreceptor 101 formed in a drum state by means of the above-mentioned charger 102, an original (not illustrated) loaded on original loading plate 200 provided on the uppermost portion of image forming apparatus 100 is started to be exposed to light by exposure lamp 201 provided inside optical frame 200A which forms optical unit 200 located at an upper portion inside image forming apparatus 100. Aforesaid original is exposed to light by means of lamp 202 which moves integrally with exposure lamp 201, V-shaped mirrors 203 and 204 which moves ½ distance of the moving distance by aforesaid mirror 202, mirrors 206 and 207 located in a V shape which follow focusing lens 205 and mirror 208 which irradiates an image onto the above-mentioned photoreceptor 101 by the use of an arrowed direction for forming an electrostatic latent image on the above-mentioned photoreceptor 101.

All of exposure lamp 201, mirror 202, V-shaped mirrors 203 and 204, focusing lens 205, V-shaped mirrors 206 and 207 and mirror 208 which irradiates an image are located inside the above-mentioned optical unit 200. In addition, optical unit 200 is maintained and fixed at a prescribed position by means of front supporting frames 300 and 301 which are respectively fixed bottom plate 100B which constitutes image forming apparatus 100 and rear surface supporting frame 302.

Next, by means of developing device 103 inside image forming unit 10A, the above-mentioned electrostatic latent image is developed, and then a visible image is formed by a toner image on the surface of photoreceptor 101.

At the lower portion of image forming apparatus 100, paper feeding unit 107 for double-sided copying and universal cassette 600 are respectively up and down fixed and located through guide members R1, R2, R3 and R4 between front supporting frames 300 and 301 which constitute image forming apparatus and rear supporting frame 302. In the above-mentioned universal cassette 600, loading plate 606 which loads recording papers P is provided. Inside image forming apparatus 100, recording papers trailing end stopping member 611 and pushing up member 617 which pushes up recording papers loading plate 606 is provided. Double-sided recording papers guide members 607 and 607A (see FIG. 2) which guides recording papers P housed in universal cassette 600 is provided. Only one sheet housed in universal cassette 600 is fed by means of paper feeding roller 109 for conveying aforesaid paper by means of conveyance roller 110. First reinforcing member 303 is provided between the above-mentioned front surface supporting frame 301 and rear surface supporting frame 302. Conveyance path 306 is formed between second recording guide member 305 which is provided openly to rear surface supporting frame 302 and first reinforcing member 303. On the above-mentioned first reinforcing member 303, recording papers guide member 304 is provided, which guides recording papers P conveyed by the above-mentioned paper feeding roller 110 to conveyance path 306.

Recording papers P are conveyed to photoreceptor 101 on which the above-mentioned toner image is formed by means of first reinforcing member 303, guide roller 307 provided on second recording paper guide member 305, above second recording papers guide member 305 and second guide roller 308 provided on image forming apparatus 100. Recording papers P temporarily stops at register roller 111 provided in image forming apparatus 100. Paper feeding starts in such a manner that a toner image formed on photoreceptor 101 and recording papers P coincide.

Next, a toner image on photoreceptor 101 is transferred onto recording papers P by means of image-transferor 104. By means of a separation device 105, recording papers P is separated from the surface of photoreceptor 101, and aforesaid recording papers P is conveyed to fixing device 115 by means of conveyance device 114. Aforesaid fixing device 115 is constituted of heat fixing roller 116 and pressure roller 117. Toner image on recording papers P is brought into pressure contact with heat fixing roller 116 so that aforesaid toner image is fixed onto recording papers P. Recording papers P in which fixing is finished is discharged by means of discharging guide roller 118. In the case of one-sided copying, discharging switching member 119 is lowered, and as it is, aforesaid recording papers P is discharged onto discharging tray 121 by means of discharging rollers 120.

In the case of double-sided copying, discharging switching member 119 rises up as illustrated. Recording papers guide section 122 is opened. Recording paper P is conveyed in a dotted arrowed direction. By means of conveyance roller 123, recording papers P is conveyed downward. Recording papers P is conveyed out of guide section 309 of third recording papers guide member 311 provided openly between the above-mentioned front surface supporting frame 300 and rear surface supporting material 302 and recording papers switching guide member 310. In addition, between the above-mentioned front surface supporting frame 300 and rear surface supporting material 302, the above-mentioned second reinforcing member 312 is provided. Recording papers guide section 313 is formed by means of third recording papers guide member 311. Recording papers P is conveyed additionally by means of recording papers guide section 313 and conveyance roller 314 provided on second reinforcing member 312. Recording papers P is conveyed until bottom plate 100B and leading end section 315 of second reinforcing member 312. At a moment when the trailing end of recording papers P passes the position of the above-mentioned recording papers switching guide member 310, recording papers P is caused to stop. Following this, recording papers P is reversed to re-start conveyance.

Reversed recording papers P is guided and conveyed inside the above-mentioned recording papers switching guide member 310, and conveyed into the above-mentioned paper feeding unit 107 for double-sided copying. Recording paper P is conveyed to the paper feeding direction by means of conveyance belt 124 provided in paper feeding unit 107 for double-sided copying, and further, is conveyed to a prescribed position by means of recording papers trailing end pressure member 125. After finish of conveyance, recording papers is re-fed by means of paper feeding roller 126. By means of conveyance roller 127 and recording papers guide member 316 provided in the above-mentioned first reinforcing member 303, recording papers P is guided to conveyance path 306. In the same manner as described above, recording papers P is conveyed to photoreceptor 101. At the rear surface of recording papers P, toner image is transferred. After fixing the toner by means of fixing device 115, aforesaid recording papers is discharged to discharging tray 121 by means of discharging roller 120.

It is possible to mount paper feeding unit, which is an optional device, below image forming apparatus 100. Constitution of paper feeding unit 400 is omitted. If recording papers P is fed to be conveyed to above aforesaid paper feeding unit 400, a toner image can be formed on recording papers P in paper feeding unit 400 since recording papers receiving port 317 which advances recording papers P from below image forming apparatus 100 is connected to the above-mentioned conveyance path 306. The above-mentioned recording papers guide members 304 and 316 are mounted slidingly. When recording papers passes the above-mentioned recording papers guide members 304 and 316, it is discharged interior. Numeral 500 represents a manual feeding device.

Image forming apparatus 100 is constituted as above, and produces a toner image on recording papers P.

Figure 2:
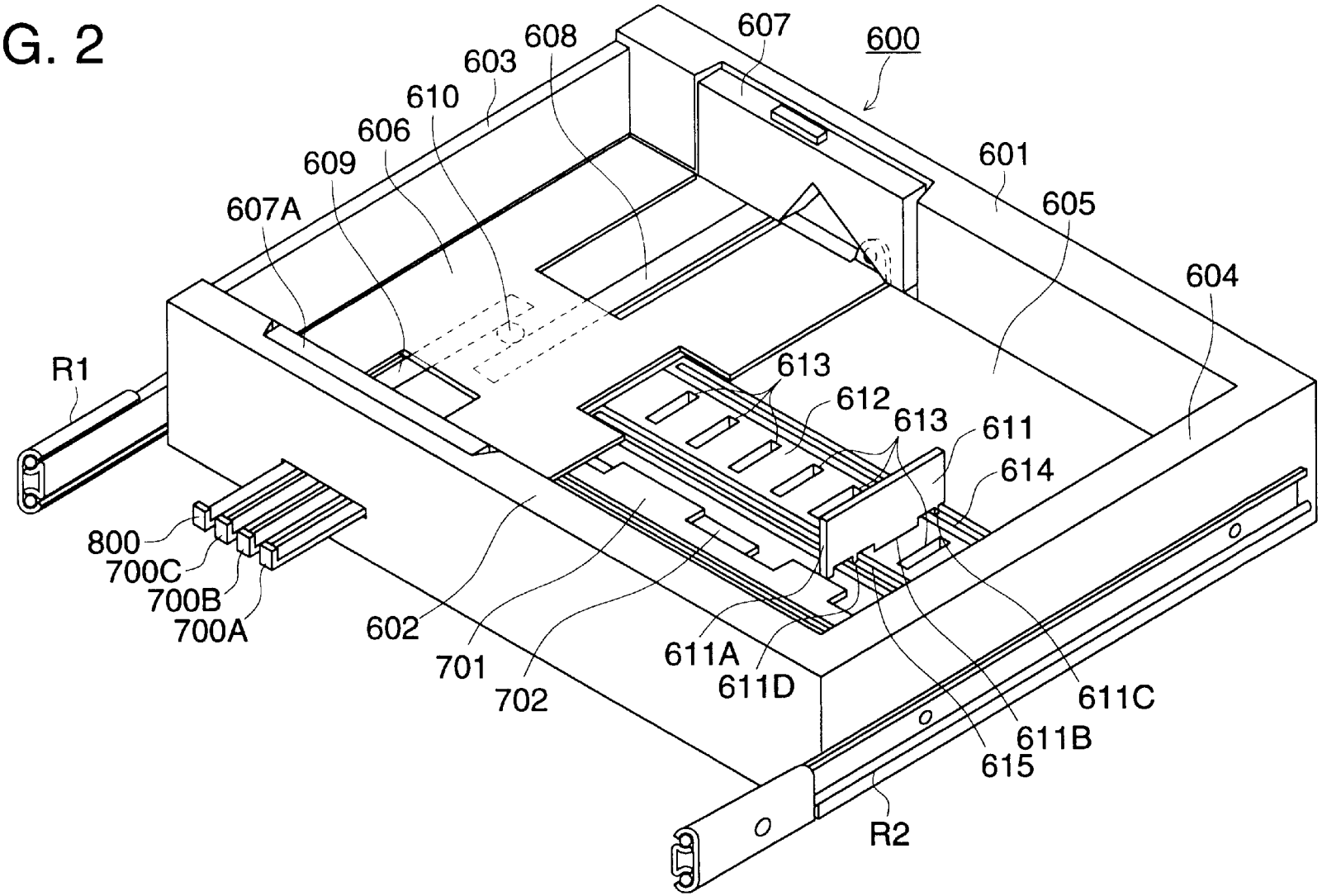
FIG. 2 is a perspective view showing a state in which a universal cassette in the image forming apparatus of the present invention is pulled out of aforesaid image forming apparatus.

FIG. 2 is a perspective view showing a state when the above-mentioned universal cassette 600 is pulled out from image forming apparatus 100.

In the above-mentioned universal cassette 600, recording papers housing section 605 which houses recording papers P is composed of both side sections 601 and 602 formed along with the recording papers feeding direction, leading end section 603 formed at the leading end along with the recording papers feeding direction and trailing end section 604 formed at the trailing end along with the recording papers feeding section. In addition, recording papers both sides guide member 607 and 607A which can freely moves inside recording papers housing section 605 are respectively housed on the above-mentioned both side sections 601 and 602.

On the above-mentioned recording papers both sides guide members 607 and 607A, in the moving direction, rack plates 608 and 609 are respectively provided. In addition, pinion 610 is provided in such a manner that it is sandwiched by aforesaid rack plates 608 and 609. By moving the above-mentioned recording papers both sides guide member 607 to the center direction in recording papers housing section 605, due to the operation of the above-mentioned rack plates 608 and 609 and pinion 610, recording papers both sides guide member 607A also moves to the center direction in recording papers housing section 605 at the same length as that of the above-mentioned recording papers both sides guide member 607. Accordingly, recording papers P is maintained to be at the central position inside recording papers housing section 605.

In addition, recording papers loading plate 606 which pushes up recording papers P while both sides of recording papers is kept by the above-mentioned recording papers both sides guide members 607 and 607A is provided at the front position of paper feeding direction inside recording papers housing section 605.

At the rear side in the paper feeding direction in recording papers housing section 605, tailing end stopping member 611 (hereinafter, referred as recording papers tailing end stopping member 611) which stops the tailing end of the recording papers is detachably provided on universal cassette 600. At one side of aforesaid recording paper tailing end stopping member 611, pushing section 611A is formed. In addition, in order to cause recording papers retailing end stopping member 611 detachable, protrusion 611B for insertion is integrally formed at the below end of recording papers retailing end stopping member 611. In order to insert aforesaid protrusion 611B, plural slots 613 for insertion are formed from the front end of paper feeding direction of recording papers P to retailing end section on detaching section 612, at respectively coping with each recording size.

At both sides of protrusions 611B for insertion of the above-mentioned recording papers retailing end stopping member 611, sub-protrusion 611C and 611D for insertion are provided. When protrusion 611B for insertion on the above-mentioned recording papers retailing end stopping member 611 inserted to slot 613 for insertion, the above-mentioned sub-protrusion 611C for insertion is engaged on grooves 614 and 615 parallelly provided with the above-mentioned plural slots 613 for insertion, fixing status of the above-mentioned recording medium trailing end stopping member 611 is completely retained.

Figure 3:
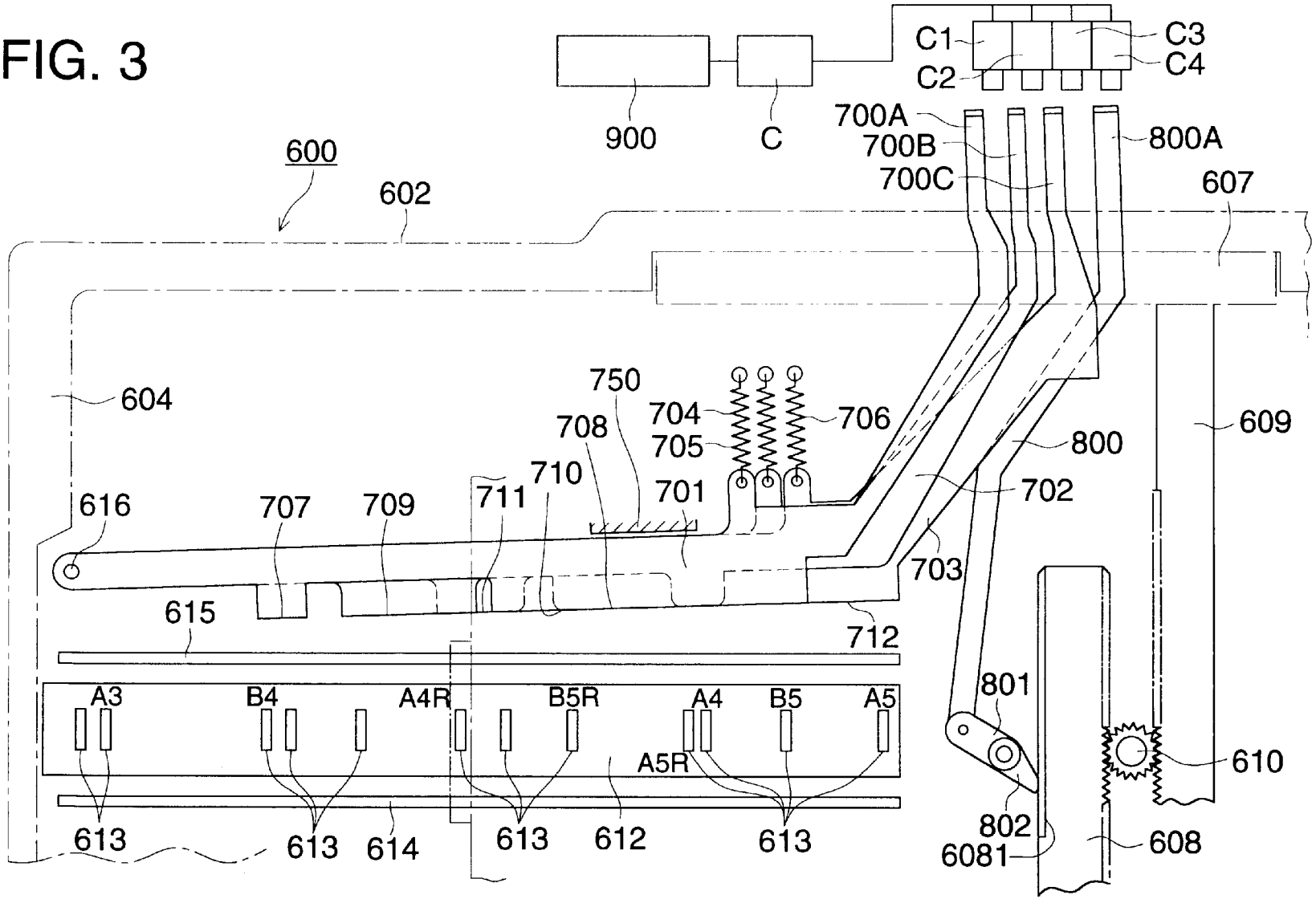
FIG. 3 is a plan view showing a state in which a universal cassette in the image forming apparatus of the present invention is pulled out of aforesaid image forming apparatus.
Figure 4:
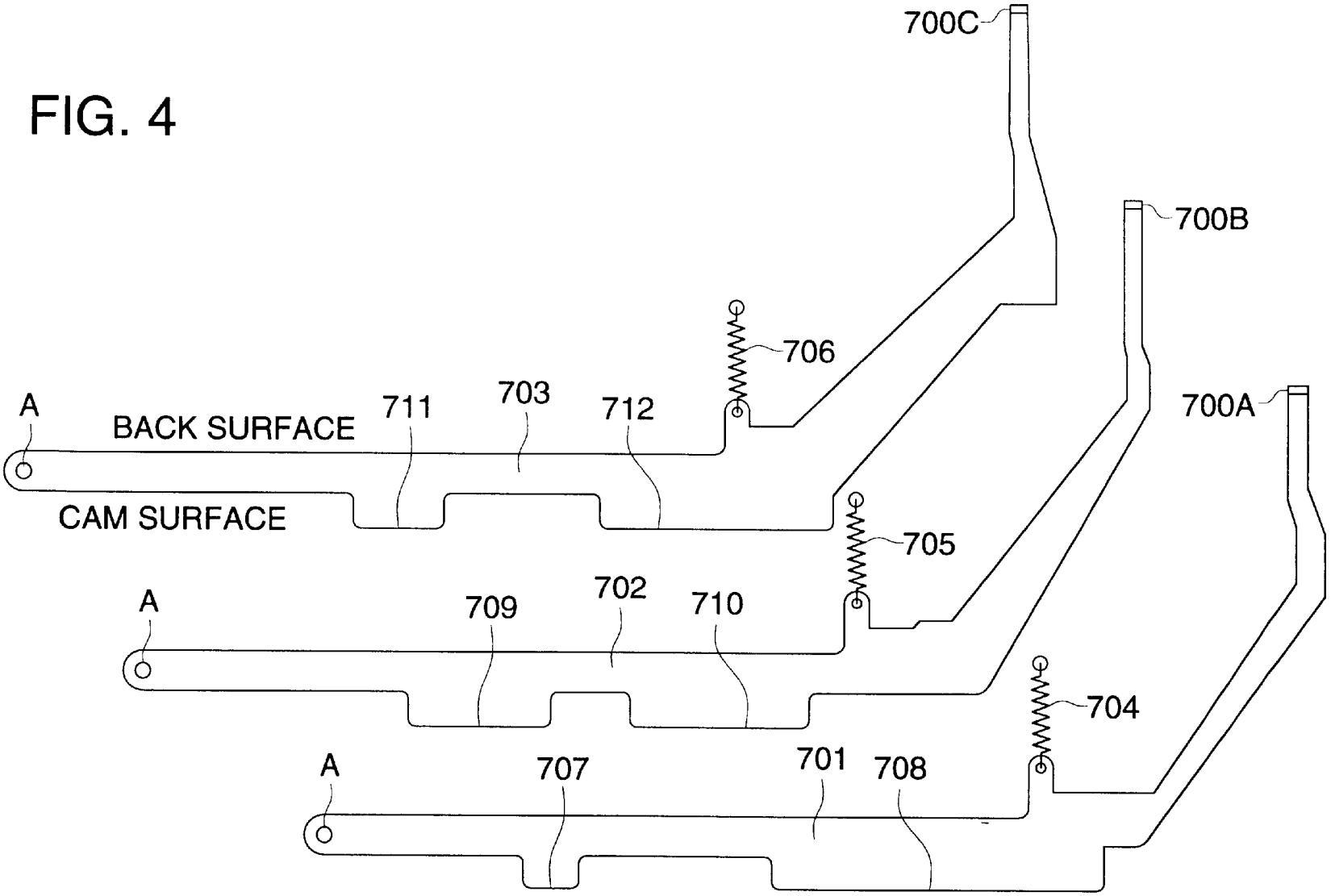
FIG. 4 is a plan view showing recording papers size detection members separately and analyzingly.
Figure 5:
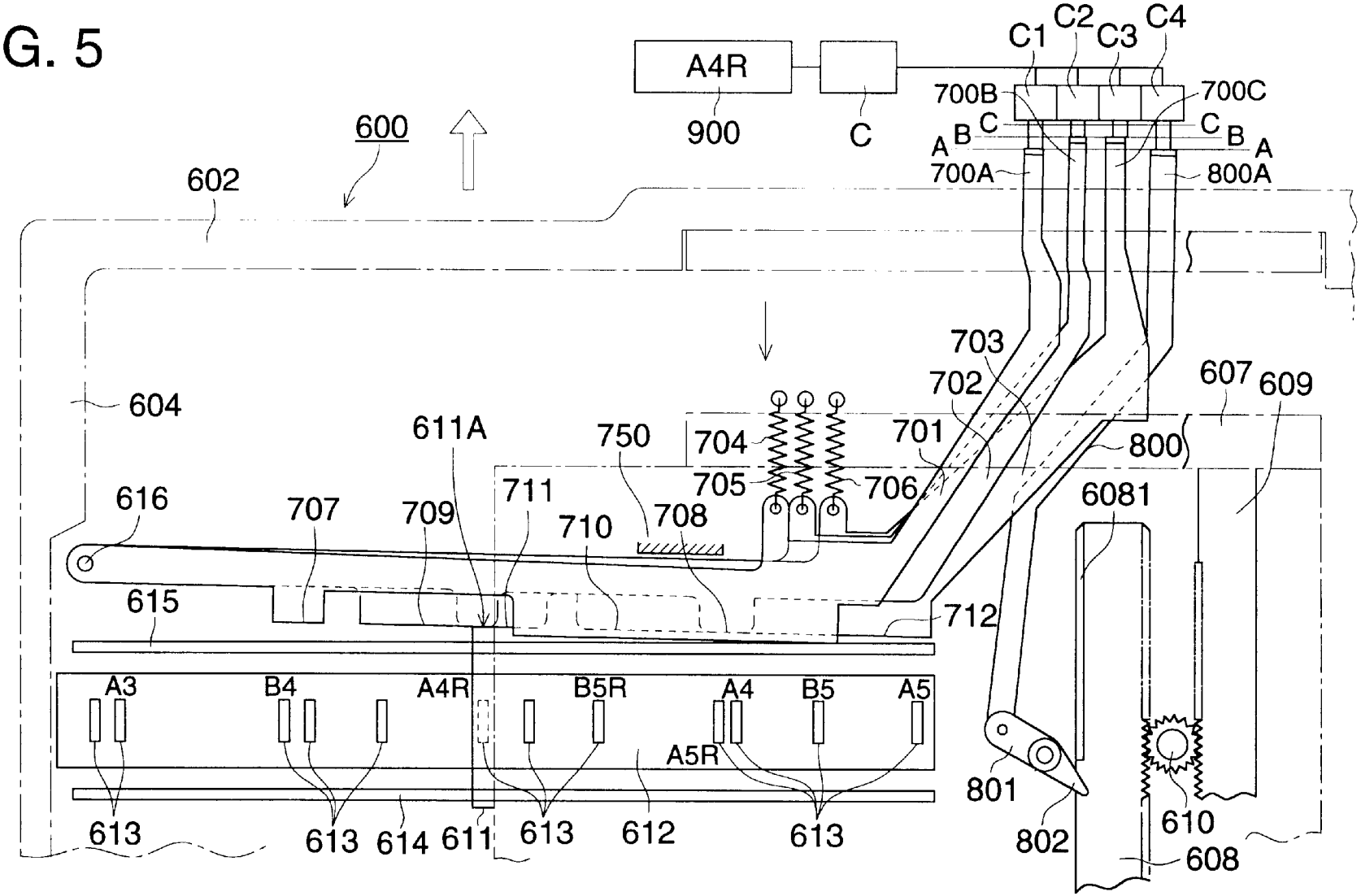
FIG. 5 is a plan view in which a recording papers trailing end stopping member is fixed in a recording papers housing section in a universal cassette in an image forming apparatus of the present invention and is housed in aforesaid image forming apparatus.

In FIGS. 3 through 5, numerals 700, 701 and 702 are plural recording papers sizes detection member, provided in recording papers housing section 605 of universal cassette 600. A cam surface provided at one side thereof faces pushing section 611A of the above-mentioned recording papers retailing end stopping member 611. Plural switches for detection. When universal cassette 600 is depressed to a prescribed position of the main body of image forming apparatus 100, pressure members 700A, 700B and 700C provided on the other side of recording paper size detection member 701, 702 and 703 are brought about contact with the protrusion portion of plural switches C1, C2 and C3 provided in image forming apparatus 100.

After aforesaid contact, the operation protrusion provided on the cam surface of a part of recording paper size detection member of the above-mentioned recording paper size detection member 701, 702 and 703 contact pushing section 611A of the above-mentioned recording paper trailing end stopping member 611. The operation protrusion of the remaining cam surface of recording paper size detection member do not contact with pushing section 611A. Aforesaid contact and non-contact are changed due to the position of the operation protrusion provided on the cam surface of recording paper size detection member and the position of slot 613 for insertion loaded in accordance with the size of recording paper. When universal cassette 600 is depressed up to a prescribed position inside image forming apparatus 100 for operating, pressure member of recording paper size detection member in which the operation protrusion of cam surface contacts pushing section 611A depresses protrusion section of a switch for detection against switch spring force due to depressing force onto universal cassette 600 so that it actuate the switch for detection "ON". On the contrary, since depressing force onto universal cassette 600 does not effect on the pressure member of recording paper size detection member in which the operation protrusion of cam surface does not contact pushing section 611A, the protrusion section of the switch for detection cannot be depressed into inside the switch against switch spring force, and the switch for detection maintains "OFF". Hereinafter, constitution and operation of the above-mentioned recording papers size detection member 701, 702 and 703 is detailed.

As described above, it is so structured that universal cassette can be pulled out of image forming apparatus 100 by means of the above-mentioned guide member R1 and R2 so that aforesaid universal cassette.

FIG. 3 is a plan view showing a state in which universal cassette is pulled out of image forming apparatus 100.

As shown in FIG. 3, inside recording papers housing section 605 of universal cassette 600, in order to insert protrusion 611B for insertion of recording papers tailing end stopping member 611, plural slots 613 are formed in the above-mentioned recording papers housing section 605 at positions corresponding to each recording paper size from the front portion to the rear portion in the paper feeding direction of recording papers P.

As shown in FIG. 3, plural slots 613 for insertion are formed for A5 size, B5 size, A4 size, A5R size, B5R size, A4R size, B4 size and A3 sizes. Along with slots 613 for insertion for each size, grooves 614 and 615 are formed.

In addition, in the above-mentioned universal cassette 600, at inner side along with plural slots 613 for insertion, on the bottom of the recording papers housing section 605, third recording papers detection member 703, second recording papers detection member 702 and first recording papers detection member 701 (the uppermost portion) are stacked in this order. Shaft holes A provided at one end of each recording paper size detection member are pivoted rotatably at core shaft 616. Due to holding each of them by elastic members 704, 705 and 706 to the inner side, the cam surface on recording papers detection members 701, 702 and 703 are significantly apart from plural slots 613 for insertion, when the above-mentioned universal cassette is pulled out from image forming apparatus 100. The rear surface of aforesaid recording papers detection members 701, 702 and 703 are stopped by stopping member 750 provided at the bottom of recording papers housing section 605.

Accordingly, pressure member 700A for first recording papers size detection member 701, pressure member 700B for second recording papers size detection member 702 and pressure member 700C for third recording papers size detection member 703 stop at the most pushing position from the above-mentioned universal cassette 600.

In recording papers housing section 605 of the above-mentioned universal cassette 600, in addition to recording papers trailing end stopping member, recording papers both sides guide members 607 and 607A which maintain both sides of recording papers P are provided. When universal cassette 600 is pulled out of the image forming apparatus, aforesaid recording papers both sides guide members 607 and 607A move to both sides 601 and 602 and opened in order to replace to newly house recording papers P.

As described above, racks 608 and 609 are provided on recording papers both sides guide members 607 and 607A are provided. Due to pinion 610 engaged with aforesaid racks 608 and 609, recording papers both sides guide members 607 and 607A synchronously move toward both sides direction of recording papers P. On aforesaid rack 608, cam plate 6081 is provided. End 802 of operation member 801 provided rotatably inside recording papers housing section 605 detaches due to the movement of cam plate 6081. At the other end of the above-mentioned operation member 801, operation lever 800 is provided. At one end of aforesaid lever 800, pressure member 800A is formed. Due to that recording papers both sides guide members 607 and 607A are opened and the above-mentioned cam plate 6081 and end 802 of operation member 801 are brought into contact with, the above-mentioned pressure member 800A is aligned with the above-mentioned pressure members 700A, 700B and 700C and stops at a position where it faces switch C4 for detection.

In addition, the above-mentioned pressure member 700A faces switch C1 for detection, the above-mentioned pressure member 700B faces switch C2 for detection and the above-mentioned pressure member 700C faces switch C3 for detection. "C" represents a control device connected with switches C1, C2 and C3 for detection switches C1, C2 and C3 respectively. Through aforesaid control device C are connected with recording papers size displaying device 900.

FIG. 4 is a plan view showing the above-mentioned first recording papers size detection member 701, the above-mentioned second recording papers size detection member 702 and the above-mentioned recording papers size detection member 703 separately and analyzingly.

As shown in FIG. 4, on the cam surface on plural slots 613 for insertion on the above-mentioned first recording paper size detection member 701, second recording paper size detection member 702 and recording paper size detection member 703, plural operation protrusions are formed while the position of each of them is changed.

Operation protrusion sections 707 and 708 are formed on the above-mentioned first recording papers size detection member 701, operation protrusion sections 709 and 710 are formed on the above-mentioned second recording papers size detection member 702 and operation protrusion sections 711 and 712 on the above-mentioned recording papers size detection member 703 are formed while the length and the position are changed in such a manner that each of operation protrusions are brought into contact with pushing section 611A of the above-mentioned recording papers trailing end stopping member in accordance with the size of recording paper.

FIG. 5 is a plan view in which recording papers trailing end stopping member 611 is fixed at a prescribed recording papers size position in recording papers housing section in the above-mentioned universal cassette 600 and then recording papers P is housed and the above-mentioned universal cassette is housed in image forming apparatus 100.

While universal cassette is pulled out of image forming apparatus 100, in order to house an A4R size recording papers P inside recording papers housing section 605, protrusion 611B for insertion of recording papers trailing end stopping member 611 is inserted to slot 613 for insertion at a position corresponding to the A4R size to be fixed. Simultaneously, protrusions 611C and 611D for sub-insertion, and are also inserted into grooves 614 and 615 and recording papers trailing end stopping member 611 is fixed onto detaching section 612. Next, numerous A4R size recording papers P are housed in recording papers housing section 605. Recording papers both sides guide members 607 and 607A are moved toward the center of recording papers housing section 605 for maintain both sides of recording papers P. Due to inside movement of recording papers both sides guide members 607 and 607A, end 802 of the above-mentioned operation member 801 is being separated from cam plate 6081.

After the above-mentioned operation, universal cassette 600 is depressed to be housed in image forming apparatus 100.

Due to pushing the above-mentioned universal cassette 600 into image forming apparatus 100, pressure members 700A, 700B and 700C respectively provided at the end of the above-mentioned first recording papers size detection member 701, the above-mentioned second recording papers size detection member 702 and the above-mentioned third recording papers size detection member 703 are respectively brought into contact with switches C1, C2 and C3 for detection. Due to further pressure operation of universal cassette 600, second recording papers size detection member 702 and operation protrusions 709 and 711 of third recording papers size detection member 703 contact pushing section 611A of the above-mentioned recording papers trailing end stopping member 611.

To second recording paper size detection member 702 and third recording paper size detection member 703, in which the operation protrusions on cam surface contact pushing section 611A, pushing force to universal cassette 600 effects. Their pressure members 700B and 700C depress switches C2 and C3 for detection into inner part of the switch against switch spring force. Pushing sections advances to line "B—B". On the contrary, to first recording paper size detection member, in which the operation protrusion on the came surface does not contact pushing section 611A, pushing force to universal cassette 600 does not effect. Here, switch spring force of switches C1, C2 and C3 for detection is stronger than the spring force by elastic members 704, 705 and 706. Therefore, first recording paper size detection member retreats against spring force of elastic member 704 due to switch spring force of switch C1 for detection, and then is separated from the stopping member. Accordingly, pushing member 700A is retained at line "A—A".

When universal cassette 600 is depressed until a prescribed fixed position, operation protrusions 711 and 709 contact pushing section 611A. Therefore, pushing force is effected. Pressure members 700B and 700C of second recording paper size detection member 702 and third recording paper size detection member 703 respectively depress the protrusion section of switches C2 and C3 for detection up to line "C—C". Due to this, switches C2 and C3 for detection become "ON".

When pushing section 611A on recording papers trailing end stopping member 611 is fixed at a position corresponding to A4R size, operation protrusions 709 and 708 on first recording papers size detection member 701 do not contact. Therefore, pushing force of the universal cassette does not effect. Accordingly, first recording papers size detection member 701 retreats due to elastic force by the switch spring. As a result, switch C1 for detection maintains "OFF" status while pressure member 700A is brought about contact with the pushing section at position "A—A".

When a recording paper is used in a "horizontal format" as in A4R, contact between end 802 of the above-mentioned operation member 801 and cam plate 6081 is released to be free, and pressure force onto the universal cassette does not effect on pressure member 800A of operation lever 800. Accordingly, switch C4 for detection maintains "OFF" status.

"ON" and "OFF" signals of the switch for detection is inputted in control device C. In the memory in aforesaid control device C, combinations of paper size and signal pattern are stored.

TABLE 1

| | | Switches | | | |
|---|---|---|---|---|---|
| | | C1 | C2 | C3 | C4 |
| Paper size | A3 | OFF | OFF | OFF | ON |
| | B4 | ON | OFF | OFF | ON |
| | A4R | OFF | ON | ON | OFF |
| | B5R | ON | ON | OFF | OFF |
| | A5R | ON | ON | ON | OFF |
| | A4 | ON | ON | ON | ON |
| | B5 | ON | OFF | ON | ON |
| | A5 | OFF | OFF | ON | OFF |

According to an example shown in FIG. 5, the signal "OFF" is inputted for C1 and C4, and the signal "ON" is inputted for C2 and C3. Therefore, control device C determines the paper size as "A4R". Recording paper size displaying section 900 displays that universal casette 600 houses size "A4R" recording papers P.

In the present embodiment, the size of recording papers were represented by "A" and "B" formats. However, the present embodiment can be applied to "inch" format.

In the present embodiment, 4 kinds of recording paper size detection members were used. However, depending upon the kind of recording paper size, it is possible to reduce the number of recording paper size detection members.

In an image forming apparatus having a universal cassette composed of a recording papers housing section capable of housing recording papers having plural kinds of paper size and a display section which displays the size of recording papers housed in aforesaid recording papers housing section, by housing aforesaid universal cassette composed of a both sides recording papers guide members which move in accordance with the size of recording papers which is housed in the above-mentioned recording papers housing section, a trailing end stopping member provided detachably inside the above-mentioned recording papers housing section for stopping the trailing end of recording papers housed in the above-mentioned recording papers housing section in paper feeding direction and a recording papers size detection member provided for detecting the size of recording papers which contact with the above-mentioned trailing end stopping member at the time of completing of loading aforesaid universal cassette into an image forming apparatus in aforesaid image forming apparatus, the above-mentioned recording papers size detection member is brought into contact with the above-mentioned trailing end stopping member for detecting the size of recording papers and the size of aforesaid recording papers is displayed on a part of aforesaid image forming apparatus. Accordingly, when the size of recording papers inside aforesaid universal cassette is changed, the fixing section of the trailing end stopping member for the recording papers is changed to a new position corresponding to the size of recording papers. At that time, since the recording papers size detection member is separated from the trailing end stopping member, detaching operation of the trailing end stopping member is easy. Simultaneously, by loading aforesaid universal cassette on aforesaid image forming apparatus fixingly, the size of recording papers can surely be displayed externally.

When the above-mentioned universal cassette is pulled out of the above-mentioned image forming apparatus, the above-mentioned trailing end stopping member is separated from the above-mentioned recording papers size detection member so that aforesaid trailing end stopping member is detachable from the recording papers housing section. Accordingly, specifically when the above-mentioned universal cassette is pulled out of the above-mentioned image forming apparatus, if change of the size of recording papers is intended, it is easy to remove the trailing end stopping member from the fixed position of the universal cassette and it is also easy to mount the trailing end stopping member again, since the trailing end stopping member is separated from the above-mentioned image forming apparatus.

The above-mentioned recording paper size detection member is constituted of plural movable detection members. At the mounted position of the above-mentioned trailing end stopping member, plural of the above-mentioned movable detection members are brought into contact with the above-mentioned the trailing end stopping member so that operation distance of plural movable detection member is changed. As a result, the size of recording papers can be detected by a movable detection member which surely operates. Therefore, when aforesaid universal cassette is loaded on the above-mentioned image forming apparatus fixingly, the size of the recording papers inside the universal cassette can be displayed synchronously with the image forming apparatus.

What is claimed is:

1. An apparatus for forming an image on a sheet, comprising:

an apparatus body in which image forming means is provided;

a universal cassette in which the sheet having one of plural different sheet sizes is selectively accommodated, the universal cassette adapted to be mounted at or dismounted from a predetermined position of the apparatus body;

the universal cassette including a sheet stacking body having a sheet feeding side from which the sheet is fed to the image forming means, plural stopping sections predetermined at different positions opposite to the sheet feeding portion in the sheet stacking body in accordance with the plural different sheet sizes, a trailing end stopper adapted to be detachably attached to one of the plural stopping sections in accordance with the sheet size to be accommodated, and a sheet size detecting member having a projecting section, wherein when the universal cassette is dismounted from the predetermined position of the apparatus body, the projecting section is spaced far from the trailing end stopper, and when the universal cassette is mounted at the predetermined position of the apparatus body, the projecting section is adapted to come in contact with or in non-contact with the trailing end stopper in accordance with the attached position of the trailing end stopper, and a display having a controller to determine the sheet size based on the contact or the non-contact between the projecting section and the trailing end stopper when the universal cassette is mounted at the predetermined position of the apparatus body and indicating the determined sheet size.

2. The apparatus of claim 1, wherein each of the plural stopping sections is provided with a hole and the trailing end stopper is adapted to be fit in the hole.

3. The apparatus of claim 1, wherein the sheet size detecting member comprises plural lever members each provided with the projecting section and the controller determines the sheet size based on the contact or the non-contact between the projecting sections of the plural lever members and the trailing end stopper.

4. The apparatus of claim 3, wherein one end of the lever member is fixed with a shaft and a middle portion of the lever member is provided with a biasing spring and wherein the lever member is rotated around the shaft by the biasing spring and is stopped by a lever stopper at a position that the projecting section provided on the lever member is spaced far from the trailing end stopper when the universal cassette is dismounted from the predetermined position of the apparatus body.

5. The apparatus of claim 4, wherein the controller has plural switches corresponding to the plural lever members and another end of the lever member is provided with a protrusion, and wherein the protrusion of the lever member comes in contact with a switch projection of the switch when the universal cassette is mounted at the predetermined position of the apparatus body.

6. The apparatus of claim 5, wherein the spring force of the switch spring is stronger than that of the biasing spring, whereby when the projecting section of the lever member comes in contact with the trailing end stopper, the protrusion of the lever member pushes the switch projection of the switch so as to turn the switch ON, and when the projecting section of the lever member comes in non-contact with the trailing end stopper, the protrusion of the lever member does push the switch projection of the switch so as to keep the switch OFF.

7. The apparatus of claim 6, wherein the controller determines the sheet size based on ON or OFF of the plural switches.

8. A universal cassette in which a sheet having one of plural different sheet sizes is selectively accommodated, the universal cassette adapted to be mounted at or dismounted from a predetermined position of an image forming apparatus having image forming means, comprising:

a sheet stacking body having a sheet feeding portion from which the sheet is fed to the image forming means, plural stopping sections predetermined at different positions opposite to the sheet feeding portion in the sheet stacking body in accordance with the plural different sheet sizes, a trailing end stopper adapted to be detachably attached to one of the plural stopping sections in accordance with the sheet size to be accommodated, and a sheet size detecting member having a projecting section, wherein when the universal cassette is dismounted from the predetermined position of the apparatus body, the projecting section is spaced far from the trailing end stopper, and when the universal cassette is mounted at the predetermined position of the apparatus body, the projecting section is adapted to come in contact with or in non-contact with the trailing end stopper in accordance with the attached position of the trailing end stopper.

* * * * *